United States Patent [19]

Osher et al.

[11] 4,412,478

[45] Nov. 1, 1983

[54] AIR DISTRIBUTION METHOD AND APPARATUS FOR EFFECTING THE SAME

[76] Inventors: John D. Osher, 8366 Gwilada Dr., Cincinnati, Ohio 45236; Tom Rattray, 233 Fleming Rd., Cincinnati, Ohio 45215

[21] Appl. No.: 322,780

[22] Filed: Nov. 19, 1981

[51] Int. Cl.[3] ..... F24F 7/00

[52] U.S. Cl. ..... 98/33 R; 98/39; 98/87; 248/225.1; 248/343

[58] Field of Search ..... 98/33 R, 39, 43 R, 87; 248/225.1, 343

[56] References Cited

U.S. PATENT DOCUMENTS 960,625 6/1910 Cowles ..... 248/343 X 2,566,630 9/1951 Powers ..... 98/39

*Primary Examiner*—Albert J. Makay

*Assistant Examiner*—Harold Joyce

*Attorney, Agent, or Firm*—Wood, Herron & Evans

[57] ABSTRACT

Apparatus and method for changing the temperature of a room by moving warm air into or out of a room, and for effecting its distribution. A fan is removably and reversibly mountable on a bracket located on the upper portion of a doorframe in a manner which will not interfere with the normal operation of the doorway, and circulates air from one room into an adjacent room or hallway to effect a more even, efficient heating or cooling of living and work areas.

6 Claims, 10 Drawing Figures

AIR DISTRIBUTION METHOD AND APPARATUS FOR EFFECTING THE SAME

BACKGROUND OF THE INVENTION

This invention relates to air distribution methods and devices, and more particularly to a ventilating fan unit which is removably and reversibly mountable in a doorframe or other room connecting passageway and which is adapted to propel air from one room into an adjacent room or space.

In most homes and work places it is very difficult to maintain a uniform temperature from room to room. Changes in wind direction or the position of the sun will cause some rooms to have a significantly higher temperature than other rooms. Further, one room might have a window air conditioning unit to cool it, while the adjoining room might not, leaving the latter uncomfortably warm. It is therefore desirable to effect a simple, economical and efficient distribution of air from one room to another to facilitate and maintain a desired temperature range throughout the living area.

As is shown in the prior art, various devices have been employed to effect a more even and efficient distribution of heated or cooled air in a single room. Westbrook, U.S. Pat. No. 4,134,545, Wolbrink, U.S. Pat. No. 4,136,606, and Whiteley, U.S. Pat. No. 3,973,479, all show related ventilating devices which attempt to overcome inefficiencies caused by stratification of air within a room, by mixing and/or recirculating air between the floor and the ceiling. As has been noted, the devices are restricted to the circulation of air within a single room enclosure, and do not contemplate the distribution of that air to other living areas.

More in point are the air distribution systems shown in McDonough, U.S. Pat. No. 3,804,156, and Luke, U.S. Pat. No. 4,168,797, which attempt to equalize temperatures between variously heated or cooled areas within a home or like structure. As is evident from a cursory examination, the patented systems both require the utilization of substantial duct-work interconnecting and built into the various affected rooms, as well as the employment of permanently fixed blower or fan elements for the one-way movement of air.

The prior art thus fails to provide an air distribution method and apparatus which is efficient, economical, and simply and reversibly mountable for alternately propelling air into and out of a room to achieve a temperature balance between two or more habitation spaces, and which does not require the utilization of any duct work to direct movement of the air circulated from one room to the next.

The prior art further fails to disclose such an apparatus that is mountable in a doorframe in a manner that prevents interference with the normal use of the door.

SUMMARY OF THE INVENTION

The air distribution method and apparatus proposed by the present invention overcomes the above mentioned failings of the prior art by providing a ventilating fan unit which is removably and reversibly mountable on a bracket located in the upper portion of a doorway frame or other room connecting passageway in a manner that prevents interference with the door and which is employed to propel air from one room into another. In a preferred embodiment of the invention, the fan unit is characterized by a compact and eye pleasing design which permits its employment in a doorway in an unobtrusive and non-obstructive manner. The fan unit can also be readily moved from one doorway to another through the use of several brackets, or multiple fan units can be utilized throughout a residence or workplace to effect an overall desired air circulation pattern.

The fan unit housing is made of a high impact styrene plastic which is molded in two separate halves. The housing halves are connected, as by screws, to form a unitary housing for the fan element and associated electric drive motor. The housing has two rows of T-shaped elements consisting of studs having laterally-projecting flanges at their upper ends which are integrally formed along the top edge of the housing, one row along the top of each housing half.

The T-shaped elements are designed to slideably engage and be retained in a bracket element which is mountable in a doorway frame. The bracket is preferably mounted on the face of the upper innermost strip of the doorframe material, which typically forms the stop border for the door. The bracket is designed to receive a single row of T-shaped elements on the fan housing, the T-shaped elements and bracket being compatibly designed such that the flanges will only be received in an orientation which keeps one side of the fan unit flush or nearly flush to the door. The fan unit can thus be reversibly mounted for operation without interfering with the normal closing of the door, and prevents the inadvertent closing of the door on the unit, thereby damaging it. The bracket is also advantageously designed to prevent the fan from significantly pivoting from a vertical orientation when mounted.

Locking stops depending from a flange of the endmost T-shaped elements provide a lock mechanism for the unit upon the bracket. The bracket is slightly smaller in length than the spacing between the stops, such that the flanges can be slightly cocked to the bracket and slid longitudinally thereon. The stops thereby drop below the bracket edge and prevent further longitudinal movement in either direction.

Although the current commercial embodiment of this invention provides the foregoing oriented reversible mounting through use of T-shaped elements and a compatible bracket, this invention contemplates modifications of this arrangement. For example, the described bracket and T-shaped elements may be reversed, such that the bracket becomes part of the fan housing and the T-shaped elements are attached to the upper portion of the doorframe. Likewise, other mounting arrangements such as a permanent magnet and steel plate combination, or a spring clip mount for an associated flange member, are within the scope of this invention.

The ability to reversibly mount the fan unit is an important attribute of the invention, since it is often desirable to change the direction of the air being propelled by the fan by 180°. For example, in a room having a cooling air conditioner, it would be desirable in the summer to move warmer air from the adjoining room into the air conditioned room, thus forcing the cooler air into the warmer room and effecting an overall cooling of the two rooms. In the winter, where that same room becomes warmer than the adjoining room, it is desirable to reverse the fan's direction so that the warmer air inside the room is propelled into the adjoining room.

A further feature of this fan unit is that it is portable, and therefore can be selectively mounted on brackets throughout a building, as the need arises. Thus, one or more fans can be moved about to establish an air distribution pattern to most effectively utilize the heated or cooled air being generated in relatively isolated areas.

An additional advantage of the instant invention is that air stratification which might normally occur in a room is prevented. This results in a concomitant energy savings since rooms which are subject to such stratification require a greater output of hot or cold air conditioning to reach and maintain a comfortable overall environment. Warmer air which would thus normally rise and form a layer adjacent the upper portion of a room is propelled out of or into an adjacent room, as desired, the fan thus forming a circulation pattern.

Other objects and advantages of the present invention will become more apparent from the following detailed description of the invention in conjunction with the accompanying drawings in which.

DETAILED DESCRIPTION OF THE INVENTION

Although it will be understood that the air distribution system of this invention might be embodied in a variety of forms which will be immediately obvious to those skilled in the art, the following description is made with reference to preferred embodiments of the invention which are designed for use to propel air from one room into an adjacent room, and which is mountable in a doorway between the rooms.

Figure 1:
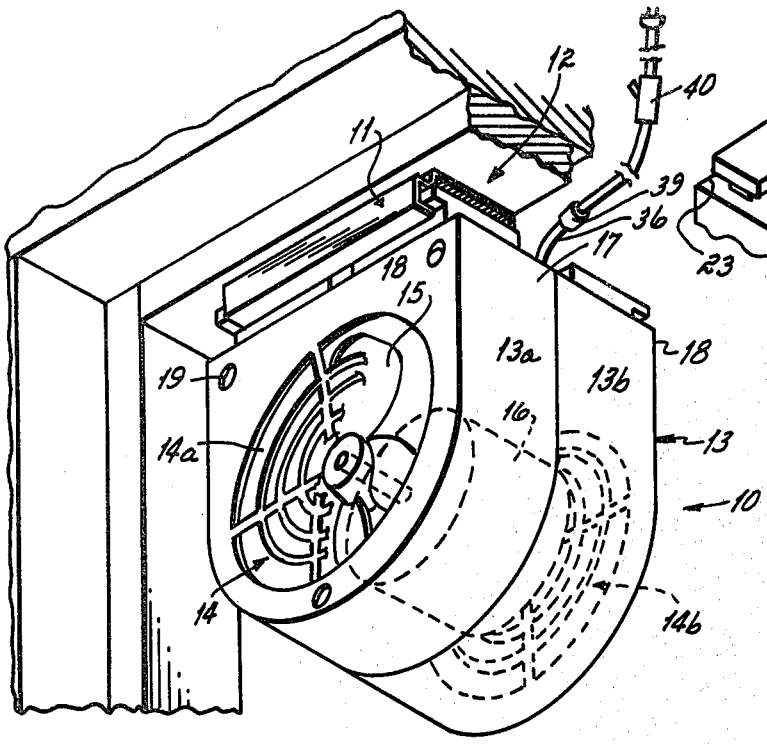
FIG. 1 is a perspective view of the fan unit mounted in a doorframe.

Referring now to the drawings, FIG. 1 shows the ventilating fan unit 10 of the instant invention mounted on a bracket 11 in a doorway 12. The fan unit 10 is composed of an outer housing 13 which is formed in two halves 13*a*, 13*b* preferably from some form of high impact styrene. Each half of the fan unit is provided with an open grillwork 14 to effect and promote the movement of air through the fan housing 13. Four fan blades 15 and associated electric drive 16 are disposed and fixed within the housing 13, the fan blades 15 serving as the propelling means to move air from one room into another. The housing 13 is designed to be compact in form and is thus tightly configured to the size of the fan blades 15 and associated motor 16, with the intent that the fan unit 10 be as small as possible and yet provide a maximum amount of air displacement. In this preferred form, a 4" diameter fan is employed, the unit having a rated capacity of 80–90 cu. ft./min., which can effectively move the entire volume of air contained in a medium sized room into an adjacent room in a span of approximately 15 minutes. Such a fan unit as described is highly effective in moving air from one room to the next, and yet is quite unobtrusive when located in the upper portion of the doorway, and presents little in the way of an obstruction to passersby.

The fan housing 13 as viewed from the front or rear is roughly semi-circular in shape, having a squared off top 17, and squared off sides 18 in the upper half of the housing. The housing 13 is about $5\frac{1}{2}$" in length along both its maximum horizontal and vertical axes, and approximately $3\frac{1}{2}$" in width from front to back. The unit presents a $4\frac{1}{4}$" diameter circular open grillwork 14*a* on the fan element side 13*a* which is centered on the fan element rotational axis, and an open grillwork 14*b* on the opposite side which is configured to roughly follow the contour of the housing. The fan motor 16 and fan element 15 combination are fixedly mounted within the housing by any suitable means (not shown). Such mounting could be by screws and associated mounting posts in one half of the unitary housing 13. The halves 13*a*, 13*b* can be assembled through the use of screws 19 or alternate fixing means may be employed, such as gluing.

A set of generally T-shaped elements 22 is provided on each half 13*a*, 13*b* of the fan unit 10, the two rows of plural T-shaped elements being set inwardly from the side edges 23 of the housing 13. In this preferred form, these rows of T-shaped elements 22 consist of three T-shaped elements 24, 25, 26 which are integrally formed with the housing half 13*a* and 13*b*, the T-shaped elements 24, 25, 26 set adjacent one another in parallel spaced relation across the top of each housing half.

Figure 2:
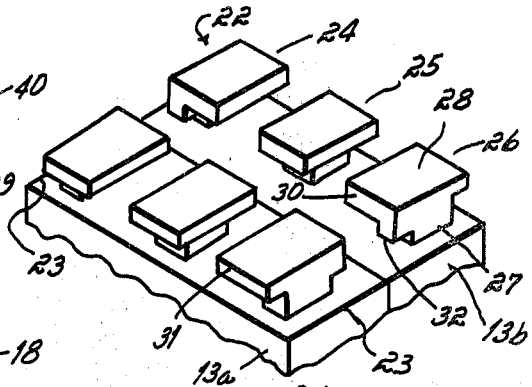
FIG. 2 is a detailed perspective view of the upper portion of the assembled fan unit.
Figure 3:
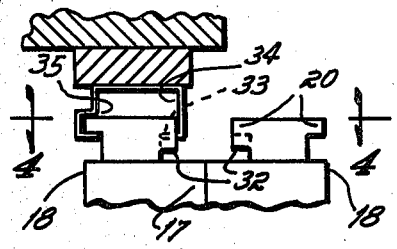
FIG. 3 is a fragmentary elevational end view of the fan unit mounted in the doorframe.
Figure 4:
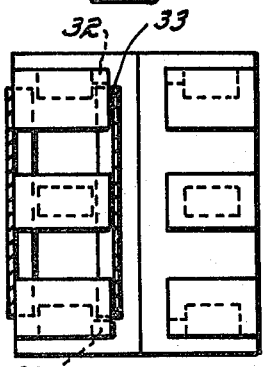
FIG. 4 is a cross-sectional view of the mounted fan unit taken along line 4—4 of FIG. 3.
Figure 5:
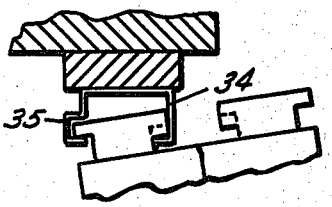
FIG. 5 is a diagrammatic view of the T-shaped elements of the fan unit in a proper mounting configuration prior to assembly with the mounting bracket.

As can be seen in FIGS. 2 and 3, these T-shaped elements 24, 25, 26 are mounted on base portions or studs 27 that are also integrally formed with each housing half 13*a*, 13*b*, and are slightly smaller than the top portion 28 to thereby provide laterally extending flange portions 20 on either side of the T-shaped elements 24, 25, 26. Stops 32 are provided on the underside of one of the flanges 20 of each of the endmost T-shaped elements 24, 26 in each row, depending from the outermost end of the interior facing edge 30 of these flanges. The bracket 11 is slightly smaller in length than the spacing between the end stops 32. A T-shaped element row 22 can be slid longitudinally onto the bracket 11 slightly cocked, that is, at a slight vertical pitch, as shown in FIG. 5, and then the flange row 22 simply locked in place once in position by vertically straightening the housing, the stops 32 thereby extending below the bracket channel edge 33 as shown in FIGS. 3 and 4. The stops 32 thus provide a positive locking mechanism against further longitudinal movement in either direction of the ventilating fan unit 10 along the mounting bracket 11.

The mounting bracket 11, which is fixed to the doorway frame as by screws (not shown), is provided with two inwardly opening side channels 34, 35 of differing vertical depths. FIG. 5 shows that the depth of the larger channel 34 is slightly greater than the thickness of the interior facing edge 30 of the flange 20 plus the associated stop 32, while the smaller channel 35 is slightly greater in vertical depth than the thickness of the exterior edge 31 of the flange 20.

It should be noted that the close clearance of the exterior flange edge 31 within the smaller channel 35 prevents the fan unit 10 from tipping away from the vertical, since the fan unit 10 is mounted off-center of its center of gravity.

Figure 6:
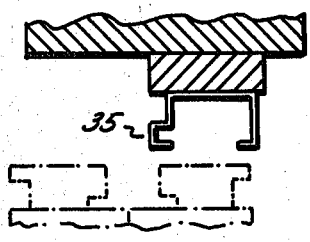
FIG. 6 is a view similar to that of FIG. 5 illustrating that the fan unit cannot be improperly mounted.

As illustrated in FIG. 6, the thicker portion of the flange 20 cannot be inserted within the smaller channel 35, but can only be inserted into and carried by the larger channel 34, as in FIG. 5. Each row of T-shaped elements 22 can thus only be inserted within the bracket 11 in a configuration in which the exterior edge 31 of the flanges 20 is inserted into and carried by the smaller channel 35, and the interior edge 30 of the flanges 20 plus the associated stops 32 is inserted into and carried by the larger channel 34.

The fan unit and associated mounting bracket 11 can thus be positioned on the doorway frame 12 in such a way that the fan unit does not interfere with door closing, the bulk of the fan unit extending to the outside of the doorframe regardless of which direction the fan unit is propelling air. Since the fan unit 10 is offset from the bracket in the same direction in either of its two positions, it thus remains flush or nearly flush with the closed door, and prevents the accidental mounting of the fan unit in a manner whereby the door could contact the unit and potentially damage it or break it off the mounting bracket.

Although the preferred embodiment is disclosed as having discrete T-shaped elements 24, 25, 26, it will be understood that a single flanged element is within the scope of this invention. Likewise, the overall contour and shape of the element used as the mounting means for the fan unit is not limited to a T-shaped element alone, the latter being employed for reference purposes only and for describing the best mode. Further, it is within the contemplation of the invention that no stops be provided on the flanges, the interior edge 30 of the flange or flanges being consequently increased in relative thickness to yield the mounting configuration described above.

Contemplated modifications within the scope of this invention, among others, include reversing the positions of the bracket 11 and T-shaped elements 22 such that the T-shaped elements 22 are mounted in the doorway 12 and the bracket 11 forms part of housing 13. It should also be immediately obvious that mounting of the fan unit 10 is not restricted to the top of the doorframe alone.

Figure 7:
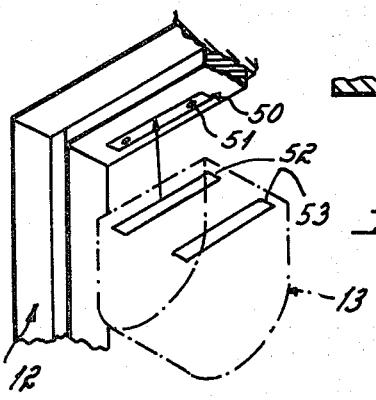
FIG. 7 is an exploded perspective view of the fan unit mounted in a doorframe in an additional embodiment employing a mount comprising a permanent magnet and steel plate combination.
Figure 8:
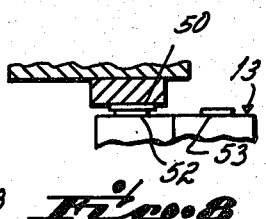
FIG. 8 is a fragmentary elevational view of the embodiment of FIG. 7 mounted in the doorframe.

An additional embodiment of this invention illustrated in FIGS. 7 and 8 has a ferrous metal plate or strip 50 fixed, as by screws 51, in the upper portion of the doorway 12. Permanent magnets, here shown as two permanent magnet strips or bars 52 and 53, are fixed in parallel spaced arrangement to the top of housing 13, such as by gluing. The fan unit 10 is thus quickly and easily mountable in the doorway 12 by contacting an appropriate magnetic strip 52 or 53 with the ferrous metal plate 50.

Figure 9:
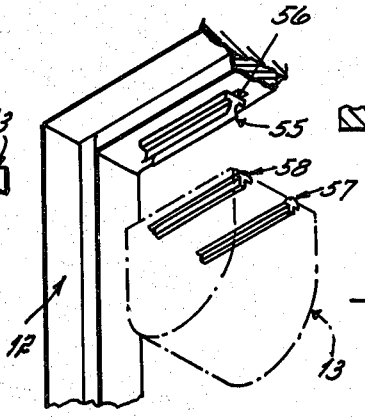
FIG. 9 is an exploded perspective view of the fan unit mounted in a doorframe in yet another embodiment employing a mount comprising a spring clip and flange combination.
Figure 10:
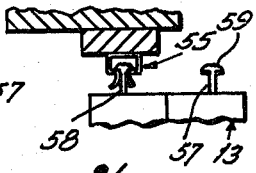
FIG. 10 is a fragmentary elevational view of the embodiment of FIG. 9 mounted in the doorframe.

Yet another embodiment is shown in FIGS. 9 and 10. A spring clip 55 is mounted in the doorway 12, as by screws 56. Two vertical flanges 57 and 58 are provided across the top of housing 13 in parallel spaced arrangement. The vertical flanges 57 and 58 each have an enlarged portion 59 along their respective top edges which serves to space apart the spring clip 55 and is then captured within the clip for mounting of the fan unit 10.

In FIG. 1, an electric cord 36 is provided for the fan motor 16 and extends from the motor through a hole (not shown) in the top of the housing 13 to an adjacent wall or floor electric outlet (also not shown). In the commercial embodiment, clip elements 39 having a contact adhesive backing are provided which are mountable along the doorframe and wall structure to direct and retain the electric cord 36 for the fan motor 16. An on/off switch 40 is provided on the electric cord 36 to operate the fan motor 16; however, although an on/off switch can effectively be employed to operate the fan motor in this manner, it is also contemplated and within the scope of this invention to provide a thermostatic control mechanism which will automatically actuate the fan in response to a sensed temperature condition, and thereupon deactuate the fan when a desired temperature has been achieved. Accordingly, the temperature conditions between two rooms can be substantially equalized within a given range automatically by the air distribution system of this invention without separate heating or cooling means being required for each room.

In the drawings and specification there has been set forth a preferred embodiment of the invention, and although specific terms have been employed, they have been used in a generic and descriptive sense only, the scope of the invention being defined in the claims.

We claim:

1. An apparatus for distributing air between rooms separated by a doorway, comprising an electric fan having a motor, a blade mounted on the motor shaft and a casing surrounding said motor blade and shaft, said casing having a substantial dimension in the direction of the axis of said shaft, a single elongated mounting element secured in said doorway and extending generally parallel to the plane of said doorway, said element being spaced off-center away from said door, a pair of spaced parallel elongated mounting elements secured to the upper surface of said casing and extending perpendicular to the axis of said motor, each of said pair of spaced mounting elements being selectively engageable with said single mounting element to provide the sole support for said fan, whereby the orientation of said fan may be selectively reversed by reversing the engagement of the spaced mounting elements with said single mounting element with the bulk of said casing located remote from said door to avoid interference with said door regardless of the position of said fan.

2. The apparatus of claim 1 wherein said single elongated mounting element is a bracket having two longitudinal channels generally parallel to the plane of the doorway, the bracket being open at at least one end for accessing said channels, and wherein said elongated fan elements are two parallel rows of spaced studs formed on said fan casing.

3. The apparatus of claim 2 further including at least one laterally-projecting flange on each of said studs, said flanges being selectively insertable in said bracket to permit reversal of the direction of said fan while avoiding interference with the closure of a door in said doorway.

4. An apparatus as in claim 1 in which said single elongated mounting element comprises one of either a ferrous metal strip or a permanent magnet, and said pair of spaced parallel elongated mounting elements comprises a pair of the other of either a ferrous metal strip or a permanent magnet.

5. An apparatus as in claim 1 in which said single elongated mounting element comprises one of either a spring clip or a member to be received within said spring clip, and said pair of spaced parallel elongated mounting elements comprises a pair of the other of either a spring clip or a member to be received within said spring clip.

6. An apparatus for distributing warm air between rooms separated by a doorway, comprising, an electric fan for blowing air into or out of a room, a bracket fixedly mounted in the interior upper portion of the doorway, the bracket having two longitudinal channels parallel to the plane of the doorway, one channel being of greater vertical depth than the other, the bracket being open at each end, and two parallel rows of spaced studs formed on said fan and parallel to the plane of the doorway, said studs being longitudinally received within the bracket, said studs each having inboard and outboard projecting flanges formed thereon extending substantially normal to said rows, said inboard flanges of each row having a relatively thicker edge than said outboard flanges, or vice versa, and a stop depending from the thicker edge of the flange of the endmost studs in each row, the length of said rows from end to end being slightly greater than the length of said deeper channel such that the stops extends slightly beyond the ends of the deeper channel when a row of studs is inserted therein, said depending stops thereby serving to relatively lock said row onto said bracket against relatively horizontal movement, said thick edges of said flanges with said stops only being receivable in said deeper channel such that the fan is offset from the bracket in the same direction in either of its two positions in a manner so as not to interfere with the normal closing of a door in said doorway, said channel of lesser vertical depth having a top and bottom spaced apart by a distance slightly greater than the vertical width of said thinner edges of said flanges such that the thinner edges are embraced therebetween and the fan is thereby prevented from tipping away from the vertical.

* * * * *